US007361151B2

(12) United States Patent
Wood

(10) Patent No.: US 7,361,151 B2
(45) Date of Patent: Apr. 22, 2008

(54) DEVICE AND KIT FOR ASSISTING IN CARDIOPULMONARY RESUSCITATIONS

(76) Inventor: Harrill D. Wood, P.O. Box 592, Ellijay, GA (US) 30540

( * ) Notice: Subject to any disclaimer, the term of this patent is extended or adjusted under 35 U.S.C. 154(b) by 10 days.

(21) Appl. No.: 11/481,727

(22) Filed: Jul. 6, 2006

(65) Prior Publication Data

US 2007/0088233 A1 Apr. 19, 2007

Related U.S. Application Data

(60) Provisional application No. 60/726,482, filed on Oct. 13, 2005.

(51) Int. Cl.
*A61H 31/00* (2006.01)

(52) U.S. Cl. ..... 601/41; 601/44

(58) Field of Classification Search ..... 601/1, 601/41, 42, 43, 44; 607/142; 128/204.21
See application file for complete search history.

(56) References Cited

U.S. PATENT DOCUMENTS

| | | | | |
|---|---|---|---|---|
| 4,077,400 | A | 3/1978 | Harrigan | |
| 5,399,148 | A * | 3/1995 | Waide et al. | 601/41 |
| 5,487,722 | A * | 1/1996 | Weaver et al. | 601/41 |
| 5,645,522 | A * | 7/1997 | Lurie et al. | 601/43 |
| 5,657,751 | A * | 8/1997 | Karr, Jr. | 128/205.18 |

* cited by examiner

*Primary Examiner*—Quang D. Thanh
(74) *Attorney, Agent, or Firm*—James Ray & Assoc.

(57) ABSTRACT

A device for assisting in cardiopulmonary resuscitations (CPR) includes a top portion for receiving a manual force applied by a person performing such CPR and a bottom portion sized to fit within a breastbone area and intermediate a plurality of ribs extending outwardly from opposed side edges of such breastbone of a person receiving such CPR and which transmits the manual force exclusively to such breastbone to cause a predetermined movement of such breastbone towards a heart. A mouth cover is provided for preventing accidental reflux discharge of the person receiving such CPR. The device, cover and a pair of gloves are provided as a convenient kit for use during CPR.

10 Claims, 4 Drawing Sheets

DEVICE AND KIT FOR ASSISTING IN CARDIOPULMONARY RESUSCITATIONS

CROSS-REFERENCE TO RELATED APPLICATIONS

This application is related to and claims priory from Provisional Patent Application Ser. No. 60/726,482 filed Oct. 13, 2005.

FIELD OF THE INVENTION

The present invention relates, in general, to medical devices and, more particularly, this invention relates to a device and kit for assisting in cardiopulmonary resuscitations.

BACKGROUND OF THE INVENTION

As is generally well known, cardiopulmonary resuscitations (CPR) is an emergency procedure used to treat victims of cardiac and respiratory arrest. When performed as a first-aid procedure, until aggressive techniques such as employing drugs and defibrillation equipment can be administered, it combines external heart massage, to keep the blood flowing through the body, with artificial respiration, to keep air flowing in and out of the lungs. The victim is placed face up. The person administering CPR places his or her hands, one on top of the other, with fingers interlocked, heel down on the victim's breastbone, leans forward, and makes 30 quick, rhythmical compressions, at a rate of about one per second, of about 2 in. This is followed by two breaths, administered using the mouth-to-mouth method of artificial respiration. CPR for infants and children differs in the ratio of compressions to breaths, and the compression of the chest is only 1 to 1.5 in. Ideally, the procedure is performed by two people, one to give mouth-to-mouth artificial respiration and one to apply external heart massage.

It is understood that CPR is a practical skill and that competency in CPR technique is particularly important. CPR training begins with professional instruction and is followed up by regular practice on a resuscitation mannequin to gain and maintain full competency.

However, even when the procedure is performed by professional personnel, it is common to cause cartilage separation. Furthermore, since chest compressions must go very deep and since the hand overlaps the width of the breastbone, it is not uncommon to crack ribs of the victim, while shallow compressions may lead to low or no blood flow to the brain of the victim. Additionally, the victim may vomit during the procedure, which is in stark contrast to the clean environment that CPR was taught in and it is important for the person administering CPR to take precautions, by way of gloves and mouth guard, against bodily fluids, particularly blood and reflux discharge.

Attempts have been made to resolve the problem of excessive or insufficient compressions. For example, U.S. Pat. No. 4,077,400 to Harrigan discloses a small inflatable "pillow" which has a pressure gage calibrated to read out the downward force or pressure applied to the victim's chest. However, Harrigan focuses only on the pressure or the applied manual force and does not address the depth of the chest compression that is extremely desirably for a proper CPR procedure.

U.S. Pat. No. 5,657,751 to Karr, Jr. teaches an extremely complex manually operated pump which includes a cylinder and a piston slideably mounted within the cylinder and connected by way of an air line to the mask placed over the victim's mouth.

SUMMARY OF THE INVENTION

According to one embodiment, the invention provides a device for assisting in cardiopulmonary resuscitations. The device includes a top portion for receiving a manual force applied by a person performing such cardiopulmonary resuscitations. A bottom portion is sized to fit within a breastbone area and intermediate a plurality of ribs extending outwardly from opposed side edges of such breastbone of a person receiving such cardiopulmonary resuscitations. The bottom portion transmits the manual force exclusively to such breastbone. Application of the manual force causes a predetermined movement of such breastbone towards a heart.

According to another embodiment of the invention, there is provided a device for assisting in cardiopulmonary resuscitations. The device includes a compressible top portion that receives a manual force generated by a person performing such cardiopulmonary resuscitations. A bottom portion is engageable with a person receiving such cardiopulmonary resuscitations for transmitting the manual force thereto. The transmitted force causes compression of a breastbone of such person receiving such cardiopulmonary resuscitations. A stop member is engageable with at least one of the top portion and the bottom portion for controlling compression of such breastbone.

According to yet another embodiment, the invention provides a mouth cover for covering a mouth of a person. The mouth cover includes a first member having a predetermined size to cover a mouth of such person and to cover a predetermined area around the mouth. The first member has an aperture disposed therein. A second member has at least a predetermined portion thereof made from a material that enables airflow therethrough. The second member is securely affixed to the first member to position the predetermined portion of the second member over the aperture of the first member.

According to a further embodiment of the invention, there is provided a kit for use during cardiopulmonary resuscitations. The kit includes a device for assisting in such cardiopulmonary resuscitations. The device is adapted for receiving a manual force generated by a person performing such cardiopulmonary resuscitations and for transmitting the manual force to a breastbone of a person receiving such cardiopulmonary resuscitations. The kit further includes a mouth cover to be placed over the mouth of the person receiving cardiopulmonary resuscitations for containing accidental reflux discharge. The kit further includes a pair of gloves for use by such person performing such cardiopulmonary resuscitations.

OBJECTS OF THE INVENTION

It is, therefore, one of the primary objects of the present invention to provide a device for assisting in cardiopulmonary resuscitations.

Another object of the present invention is to provide a device for assisting in cardiopulmonary resuscitations which controls the depth of chest compression.

Yet another object of the present invention is to provide a device for assisting in cardiopulmonary resuscitations which is suitable for use on children and adults.

A further object of the present invention is to provide a device for assisting in cardiopulmonary resuscitations which is simple to manufacture.

Yet a further object of the present invention is to provide a device for assisting in cardiopulmonary resuscitations which is simple to use.

An additional object of the present invention is to provide a device for assisting in cardiopulmonary resuscitations which can be secured to the victim's chest during cardiopulmonary resuscitations.

Another object of the present invention is to provide a kit for assisting in cardiopulmonary resuscitations which shields the person administering such cardiopulmonary resuscitations from the victim's bodily fluid discharge.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE VARIOUS EMBODIMENTS OF THE INVENTION

Figure 1:
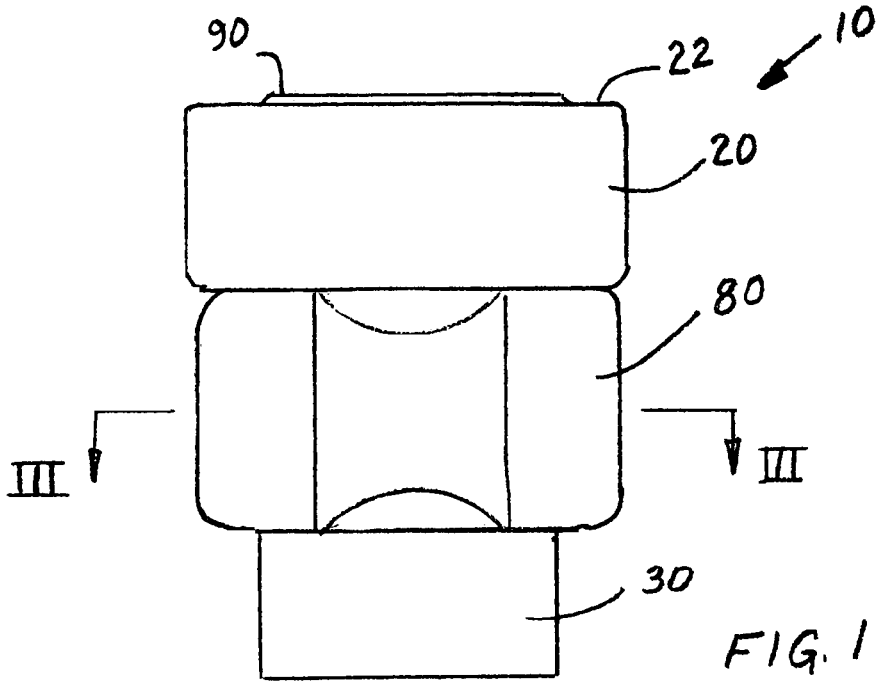
FIG. 1 is a front elevation view of a device of the present invention for assisting in cardiopulmonary resuscitations.
Figure 2:
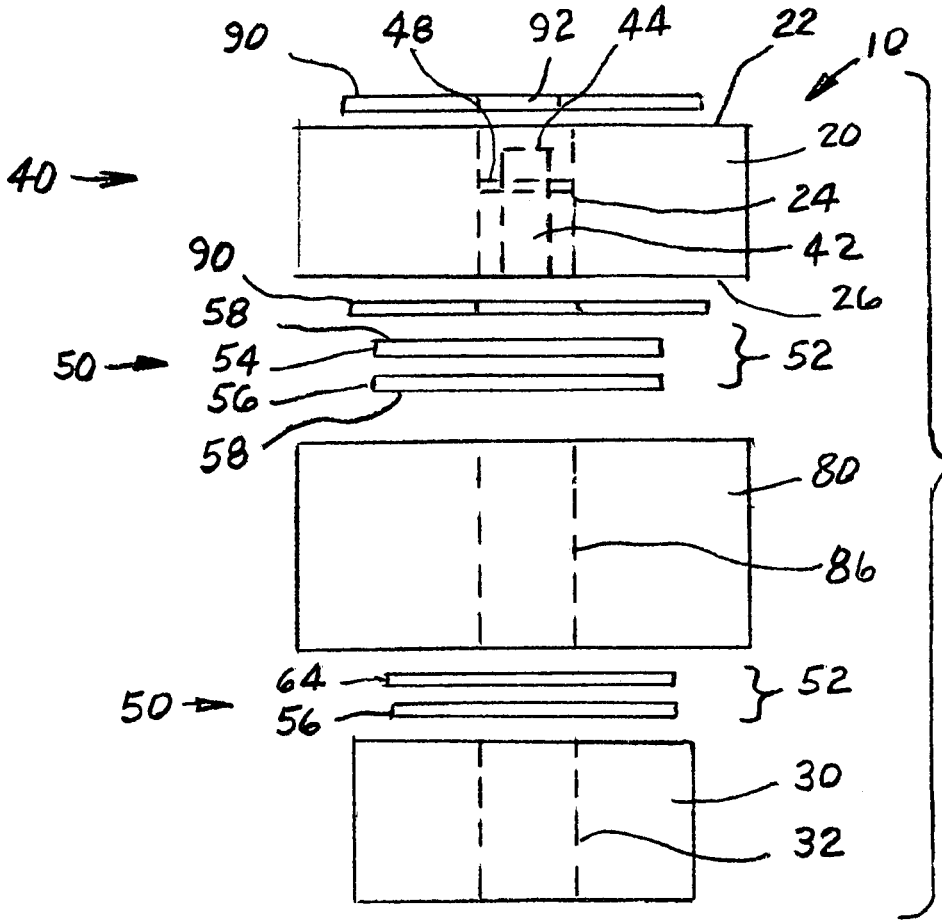
FIG. 2 is an exploded schematic representation of the assist device of FIG. 1.

Prior to proceeding to the more detailed description of the present invention, it should be noted that, for the sake of clarity and understanding, identical components which have identical functions have been identified with identical reference numerals throughout the several views illustrated in the drawing figures.

According to a first embodiment of the invention, there is provided a device, generally designated 10, for assisting in cardiopulmonary resuscitations (CPR). Now refer to FIGS. 1-4. The device 10 shown therein includes a top portion 20, which is preferably compressible and is adapted for receiving a manual force applied by a person 2 performing such cardiopulmonary resuscitations. The manual force is applied by the palm 4 of the person 2 to a top surface 22 of the top portion 20.

There is a bottom portion 30 sized to fit within a breastbone 6 and intermediate a ribcage 8 extending outwardly from opposed side edges of such breastbone 6 of a person 3 receiving cardiopulmonary resuscitation. Advantageously, the bottom portion 30 transmits the manual force exclusively to such breastbone 6, wherein the transmitted force causes a predetermined movement of such breastbone 6 towards the heart (not shown).

Preferably, the bottom portion 30 is compressible and includes an axial aperture 32 which is disposed generally vertically during such cardiopulmonary resuscitation. As it has been discovered during testing, the aperture 32 improves recovery of the compressible bottom portion 30 and its return into an original position when application of the manual force is cyclically terminated.

The device 10 includes means, generally designated 40 engageable with at least one of the top portion 20 and bottom portion 30 for controlling compression of breastbone 6.

In the presently preferred embodiment of the invention, the compression controlling means 40 includes a longitudinal aperture 24 disposed axially within top portion 20 and generally vertically during the compression of the device 10. A rigid stop member 42 is mounted within the aperture 24. The stop member 42 has a first end 44 thereof disposed at a predetermined distance below the top surface 22 of the top portion 20.

The predetermined distance is related to the material used in manufacturing the device 10 and to the desired degree of compression of the breastbone 6. The first end 44 abuts such palm 4 of the person 2 performing CPR during compression of the top portion 20. The application of the manual force is discontinued when the palm 4 of such person 2 performing such cardiopulmonary resuscitations contacts the first end 44 of the rigid stop member 42 causing such breastbone 6 to move away from the heart (not shown). Polyvinyl chloride (PVC) tubing material is advantageous in manufacturing such rigid stop member 42 due to generally inexpensive costs of the material and of the manufacturing process and further due to a reaction force applied by the tubular shape of the first end 44 onto the palm 4 of the person 2 performing CPR.

The device 10 may be constructed in a manner wherein the top portion 20 and the bottom portion 30 are formed as a unitary piece or secured together in a permanent manner, for example by way of an adhesive (not shown). Preferably, top portion 20 and bottom portion 30 are made as individual portions and device 10 includes a fastening means, generally designated 50, for securing bottom portion 30 to top portion 20 in a removable manner.

In the presently preferred embodiment of the invention, fastening means 50 is a loop and hook fastener 52 which has a first portion 54 thereof attached to one of the top portion 20 and the bottom portion 30 by way of an adhesive 58 and which has a second portion 56 thereof attached to an opposed one of the top portion 20 and the bottom portion 30 by adhesive 58.

The second end 46 of the stop member 42 contacts the rear surface of one of first portion 54 and the second portion 56 and therefore, the loop and hook fastener 52 is also advantageous for securing such stop member 42 within aperture 24. It is preferred for the stop member 42 to form an air pocket within the aperture 24 to improve recovery of the top portion 20 during compressions. Accordingly, a simple disk like member 48 is disposed within the aperture 24 for maintaining such generally vertical orientation of stop member 42.

Figure 4:
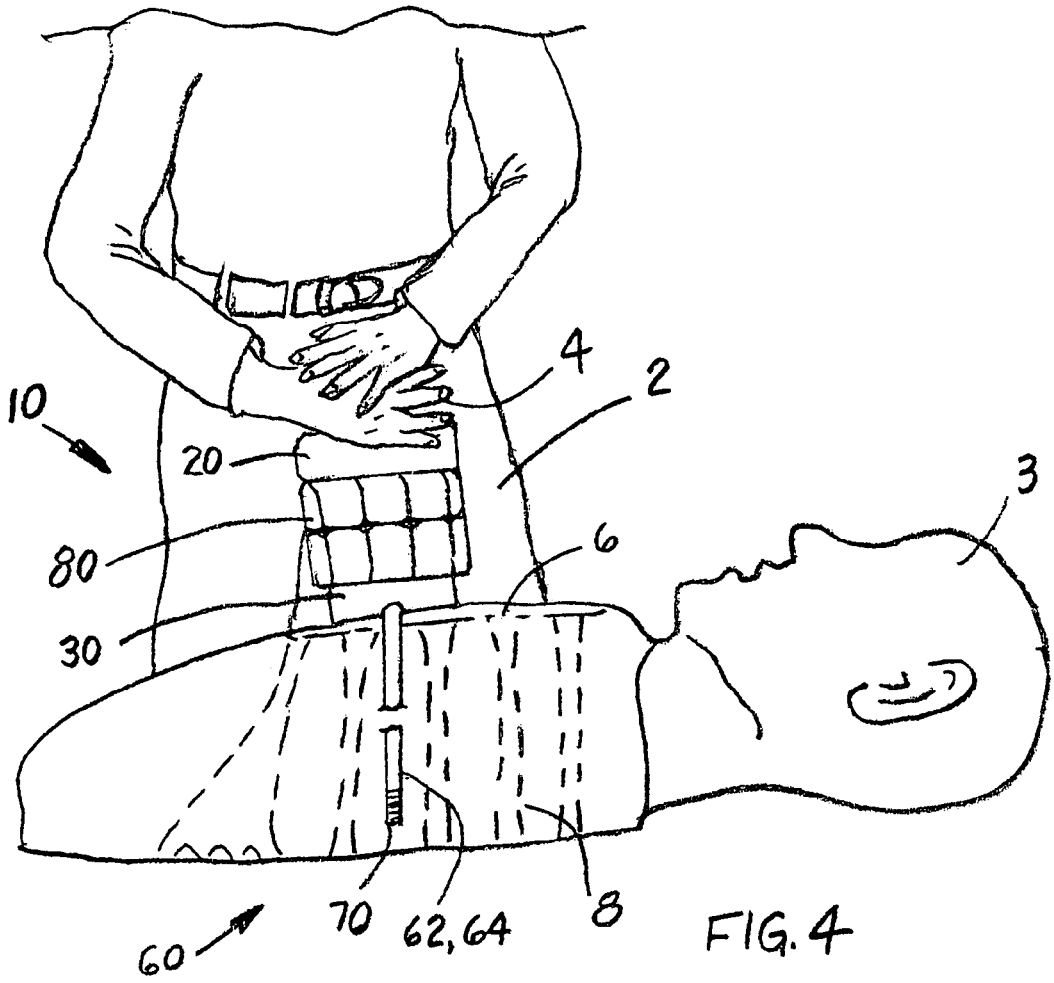
FIG. 4 is an elevation view of the assist device of FIG. 1 illustrated in use for performing chest compressions.
Figure 3:
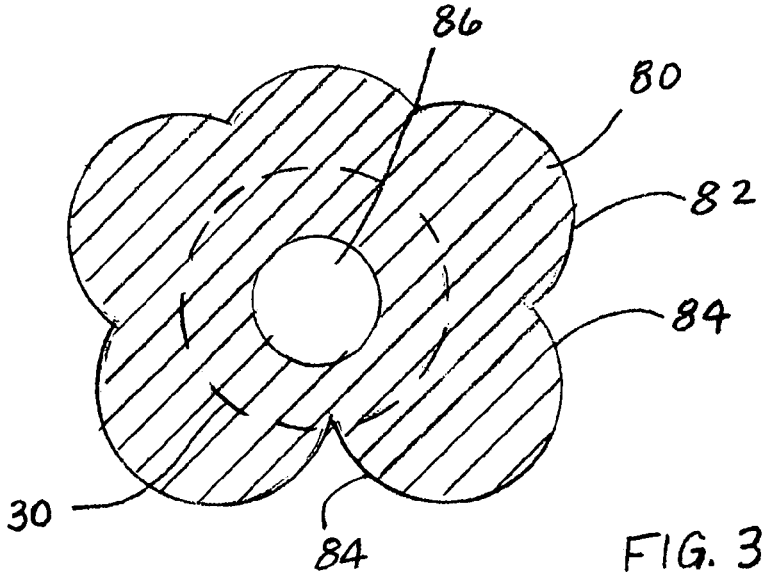
FIG. 3 is a cross-sectional view of the assist device taken along the lines 3-3 of FIG. 1.

In operation, as best shown in FIG. 4, the bottom portion 30 is positioned over breastbone 6 and top portion 20 is affixed to the bottom portion 30 and below the palm 4 of the person 2 performing such CPR. The person 2 applies manual force to top portion 20 which is transferred through bottom portion 30 to breastbone 6 causing it to move towards the heart.

When at least one of top portion 20 and bottom portion 30 is made from a compressible material, the device 10 partially compresses during application of the manual force and returns towards the original position when application of the manual force is cyclically terminated.

When sufficient movement of the breastbone 6 is achieved, the person 2 terminates application of the manual force enabling the breastbone 6 to move away from the heart and further enables device 10 to return into an original position. The person 2 then repeats applying and discontinuing application of the manual force. Such reciprocal application and termination of the manual force produces rhythmical compressions of breastbone 6.

Employment of the compression controlling means 40 enables the person 2 to terminate applications of the manual force upon contact with the stop member 42.

It will be appreciated that since the bottom portion 30 is sized to fit within the area of breastbone 6, the manual force is not applied directly to the ribcage 8 of the person receiving CPR thus preventing the undesirable cracking of the ribs or separation of the cartilage which connects the ribs to the breastbone 6.

To maintain positioning of the device 10, it may further include a harness means, generally designated 60, for temporarily securing the device 10 in a position for performing such CPR. Such securing means may include, for example, a pair of straps 62 and 64, each having a first end attached to the device 10 and, more particularly, the bottom portion 30 and having a second end at least partially wrapping a body portion of such person 2. A fastening means 70 is engageable with the second end of each strap for fastening the second ends together in a removable manner. Preferably, such fastening means 70 is a loop and hook fastener 70.

In the presently preferred embodiment of the invention, top portion 20 and bottom portion 30 are made from a flexible foam, preferably of a closed cell type. The height of the bottom portion 30 is about 1.5 inches and the height of top portion 20 is also about 1.5 inches resulting in compression of the breastbone 2 of between about 1 inch and 1.5 inches which is sufficient for children. Each of the bottom portion 30 and the top portion 20 have a round shape with diameters of 2.5 inches and 4.0 respectively.

To achieve about 2.0 inch compression of the breastbone 6, as required for adults, the device 10 further includes a third portion 80 disposed intermediate top portion 20 and bottom portion 30. Preferably, third portion 80 is also made from a closed cell flexible foam and compresses less than the top portion 20 and the bottom portion 30 during such CPR. To achieve this, the peripheral edge 82 of third portion 80 is formed in a scalloped manner by incorporating a plurality of edge notches 84 which provides for such reduced compression condition.

Preferably, third portion 80 is connected to the bottom portion 30 and top portion 20 with a pair of fastening means 50.

In order to improve recovery of the compressible third portion 80 and its return into an original position, such third portion 80 is adapted with an axial aperture 86 which is disposed generally vertically during such CPR and in alignment with aperture 32 of bottom portion 30 and aperture 24 of the top portion 20.

In order to improve stability of device 10 during use, such device 10 includes a pair of plate like members 90 with the first plate like member 90 being permanently attached to the top surface 22 and the second plate like member being permanently attached to a bottom surface 26 of the top portion 20. When top portion 20 includes aperture 24 and device 10 includes the compression controlling means 40, an aperture 92 is centrally disposed within each plate like member 90 and is further aligned with aperture 24 and with aperture 32 of bottom portion 30 or aperture 86 of the middle portion 80. Each plate like member 90 is preferably made from a light weight plastic and is preferably about 0.060 inches thick.

The presently preferred overall height of the device 10 including the top portion 20, the bottom portion 30 and the third portion 80 is about 5.0 inches which is sufficient for preventing contact between such palm 4 of such person 2 performing such CPR and a body portion of a person receiving such CPR. Thus, the person 2 will be prevented from contacting undesirable matter such as blood, contaminants and the like during such CPR.

One advantage of using the closed cell flexible foam, which is a well known dielectric material, and further in combination with the presently preferred height of the device 10, is that the person 2 is prevented from receiving electrical shocks accidentally generated by the defibrillating equipment (not shown) used by emergency response personnel. During use, the defibrillating pads are placed onto the body of the person 3 experiencing cardiac arrest and the equipment is set to cycle ON and OFF at preselected time intervals. The electric shock hazard may occur when the equipment is malfunctioning or when the person 2 performing CPR is not aware of the next ON cycle.

By using the device 10 of the present invention, the palm 4 of the person 2 does not come into contact with the body portion of the person 3 receiving such CPR and, therefore, the accidental electrical shock will not transfer to the person 2.

Another advantage of using closed cell flexible foam material is that it is generally inexpensive thus enabling such device 10 to be discarded after a single use.

It should be appreciated that other materials may be used in the present invention. For example, a visco-elastic polyurethane foam, which is a memory foam, may be used in applications requiring continuing reuse of the device 10. The device 10 can also be made from an elastomeric material such as natural rubber, synthetic rubber and a combination thereof.

As it has been found during testing, the device 10 constructed according to the embodiments described above reduces the manual force necessary to cause required compressions of the breastbone 6 by at least 30 percent. The reduction in manual force is due to the fact that the bottom portion 30 transfers the manual force applied to the top portion 20 directly to the breastbone 6 and eliminates application of such force to the ribcage 8.

According to a second embodiment, the present invention provides a mouth cover, generally designated 100, usable for covering a mouth 104 of the person 102 receiving CPR. Now in reference to FIGS. 5-6, cover 100 includes a first member 110, having a predetermined size, which covers both the mouth 104 of such person 102 and a predetermined area adjacent the mouth 104. The first member 110 has an aperture 112 disposed therein. An edge notch 114 is disposed within the first member 110 for fitting around a nose 106 of such person 102 when the mouth cover 110 is positioned over such mouth 104.

In the presently preferred embodiment of the invention, the first member 110 has a generally round shape and measures about 0.06 inches in thickness and about 3.0 inches in diameter. The aperture 112 is preferably round and has a diameter of about 1.0 inch. The presently preferred material of first member 110 is a closed cell flexible foam.

A second member 120 has at least a fist portion 122 made from a material which enables air flow therethrough. Preferably, the material is a paper cloth filter. The second member 120 is securely and, preferably, permanently attached to the first member 110 by an adhesive.

Figure 7:
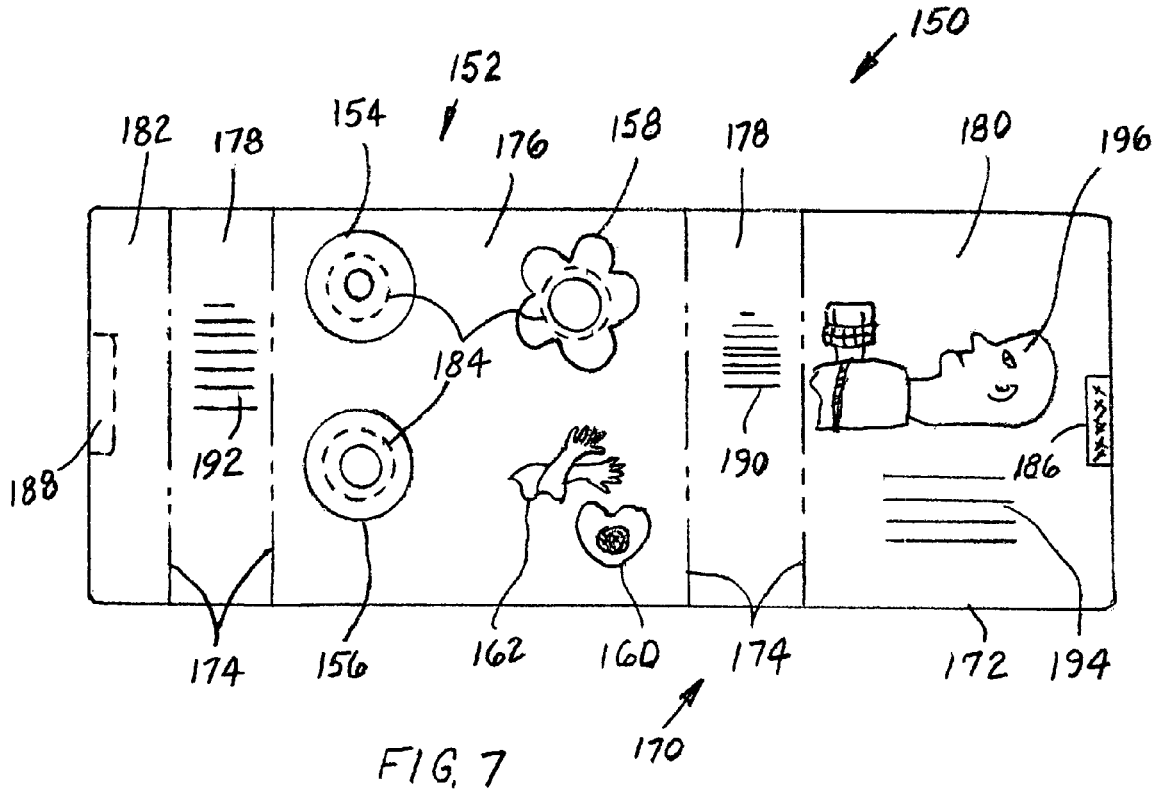
FIG. 7 is a plan view of a kit for assisting in cardiopulmonary resuscitations.

According to a third embodiment of the invention, there is provided a kit, generally designated 150, for assisting in CPR. Now in reference to FIGS. 7-8, the kit 150 includes a device, generally designated 152, for assisting in such CPR which is preferably constructed according to embodiments of FIGS. 1-4. Briefly, the device 152 is adapted for receiving a manual force generated by a person 2 performing such CPR and for transmitting such manual force to a breastbone 6 of a person receiving such CPR. The device 152 includes a top portion 154, the bottom portion 156 and the middle portion 158.

Figure 5:
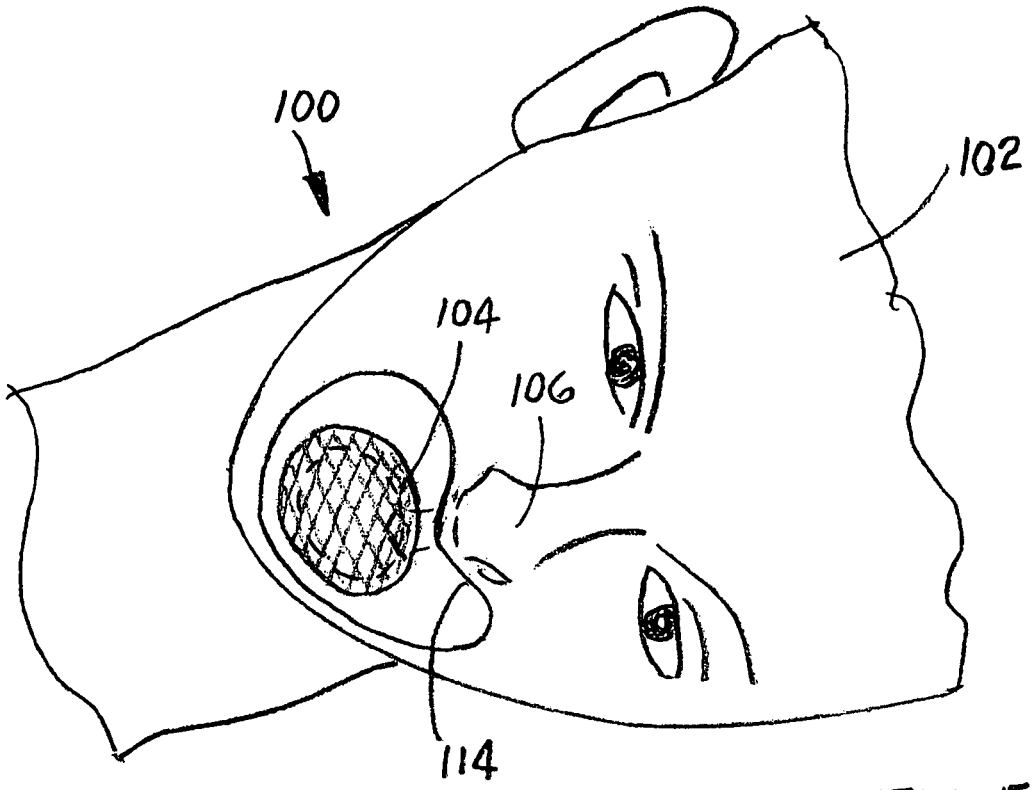
FIG. 5 is a perspective view of a mouth cover of the present invention for use in combination with the assist device of FIG. 1.
Figure 6:
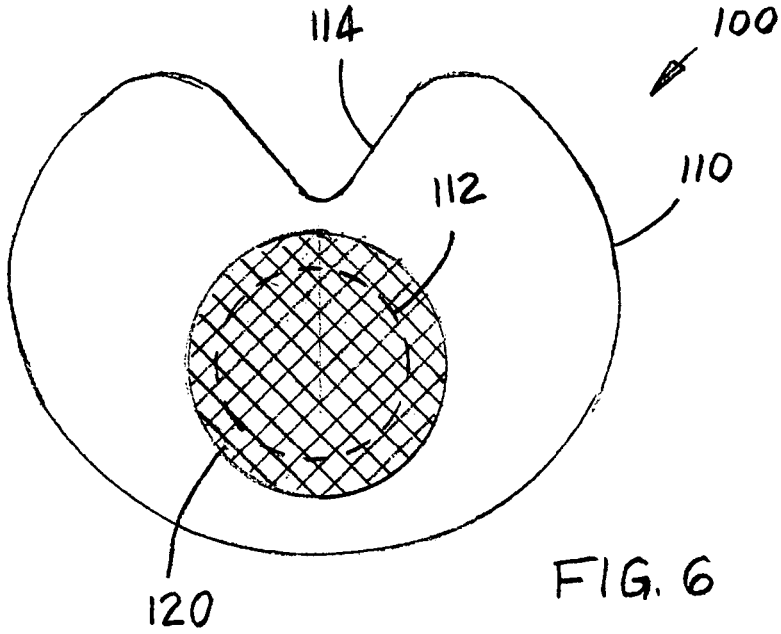
FIG. 6 is a plan view of the mouth cover of FIG. 5.

The kit 150 further includes the mouth cover 160 which is preferably constructed according to the embodiments of FIGS. 5-6. In use, the cover 160 is placed over the mouth 104 of the person 102 receiving such CPR for containing accidental reflux discharge. Also included is a pair of gloves 162 to be worn by the person 2 performing such CPR.

In the presently preferred embodiment of the invention, the kit 150 further includes a case, generally designated 170 for storing and carrying the device 152, the mouth cover 160 and the pair of gloves 162.

In the presently preferred embodiment of the invention, the case 170 includes an elongated, generally thin member 172 which is foldable along fold lines 174 and is divided into five distinct portions by such fold lines 174. The first portion 176 is used for storing each portion of the device 152 and accordingly, a plurality of mating portions 184 of the loop and hook fastener are secured to such first portion 176 for individually retaining the top portion 154, the bottom portion 156 and the middle portion 158. The mouth cover 160 and the pair of gloves 162 may be retained by a releasable adhesive or may be provided with mating portions of the loop and hook fastener.

One of the pair of side portions 178 is employed for containing indicia 190 associated with an assembly procedure of the device 152 for use on adults and the other one of the pair of side portions 178 is employed for containing indicia 192 associated with an assembly procedure of the device 152 for use on children.

Figure 8:
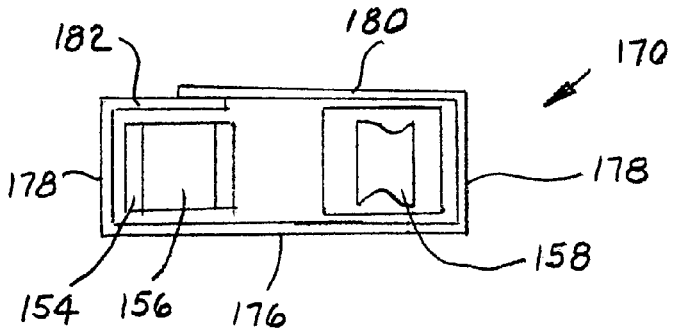
FIG. 8 is an elevation view of the kit of FIG. 7, particularly illustrating such kit in a carrying condition.

The first flap portion 180 contains the indicia 194 associated with instructions on performing CPR in combination with the device 152 and the mouth cover 160. Optional graphic indicia 196 may be provided for graphically illustrating the use of the device 152 and the mouth cover 160. Complimentary portions 186 and 188 of the loop and hook fastener are affixed to the first flap 180 and a second flap 182 for securing such elongated member 172 in a folded condition, as best shown in FIG. 8.

It should be apparent to those skilled in the art that various portions of the device 152, the cover 160 and the pair of gloves 162 may be retained by other means. For example, the first portion 176 of the elongated member 170 may include a plurality of cavities (not shown) for securing such various portions of device 152, cover 160 and the pair of gloves 162.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

I claim:

1. A device for assisting in cardiopulmonary resuscitations (CPR), said device comprising:

(a) a compressible top portion for receiving a manual force directly applied thereto by a person performing such CPR, said top portion has a longitudinal axis thereof which is disposed generally vertically when said device is employed for the assisting in such CPR;

(b) a compressible bottom portion which is axially aligned with said top portion and which is sized to fit in abutting engagement within a breastbone area and intermediate a plurality of ribs extending outwardly from opposed side edges of a breastbone of a person receiving such CPR, said bottom portion for transmitting said manual force exclusively to such breastbone wherein said transmitted force causes a predetermined movement of such breastbone towards a heart;

(c) means engageable with said top portion for controlling compression of said device; wherein said compression controlling means includes a longitudinal aperture disposed axially within said top portion and generally vertically during said compression of said device and a rigid stop member mounted within said aperture, said stop member having one end thereof disposed a predetermined distance below a top surface of said top portion being in uncompressed condition, said one end of said rigid member abutting a palm of such person performing such CPR during compression of said top portion, whereby such person performing such CPR terminates application of said manual force upon contact with said rigid stop member causing such breastbone to move away from such heart.

2. The device, according to claim 1, wherein said device further includes a harness means for temporarily securing said device in a position for performing such CPR.

3. The device, according to claim 2, wherein said harness means is a pair of straps each having a first end attached to a predetermined portion of said device and having a second end at least partially wrapping a body portion of such person receiving such CPR and a fastening means for fastening said second ends to each other in a removable manner.

4. The device, according to claim 1, wherein said device further includes a fastening means for securing said bottom portion to said top portion in a removable manner.

5. The device, according to claim 4, wherein said fastening means is a loop and hook fastener which has a first portion thereof attached to one of said top portion and said bottom portion and which has a second portion thereof attached to an opposed one of said top portion and said bottom portion.

6. The device, according to claim 1, wherein said device further includes a third portion disposed intermediate said top portion and said bottom portion.

7. The device, according to claim 1, wherein a material of at least one of said top portion and said bottom portion is a flexible foam.

8. The device, according to claim 7, wherein said flexible foam is a closed cell flexible foam.

9. The device, according to claim 1, wherein a height of said device is predetermined to prevent contact between such hand of such person performing such CPR and a body portion of a person receiving such CPR during compression of said device.

10. A device for assisting in cardiopulmonary resuscitations (CPR), said device comprising:

(a) a compressible top portion for receiving a manual force directly applied thereto by a person performing such CPR, said top portion has a longitudinal axis thereof which is disposed generally vertically when said device is employed for the assisting in such CPR;

(b) a compressible bottom portion which is axially aligned with said top portion and which is engageable with a person receiving such CPR for transmitting said manual force for exclusively transmitting said manual force to a breastbone area of such person receiving such CPR, wherein said transmitted force causing compression of such breastbone of such person receiving such CPR;

(c) means engageable with said top portion for controlling compression of such breastbone, said compression controlling means including a longitudinal aperture disposed axially within said top portion and generally vertically during said compression of said device and a rigid stop member mounted within said aperture and having one end thereof disposed a predetermined distance below a top surface of said top portion being in uncompressed condition, said one end of said stop member abutting a palm of such person performing such CPR during compression of said top portion, whereby such person performing such CPR terminates application of said manual force upon contact with said rigid stop member causing such breastbone to move away from such heart; and (d) a third portion which is disposed intermediate said top portion and said bottom portion and which compresses less than said top portion and said bottom portion during such CPR.

* * * * *